United States Patent [19]

Long et al.

[11] Patent Number: 4,877,079

[45] Date of Patent: Oct. 31, 1989

[54] COUNTERFLOW ELECTROMAGNETIC STIRRING METHOD AND APPARATUS FOR CONTINUOUS CASTING

[75] Inventors: Lawrence J. Long, Crafton; James A. Henrickson, Freedom, both of Pa.

[73] Assignee: Westinghouse Electric Corp., Pittsburgh, Pa.

[21] Appl. No.: 258,069

[22] Filed: Oct. 14, 1988

Related U.S. Application Data

[63] Continuation of Ser. No. 107,436, Oct. 9, 1987, abandoned.

[51] Int. Cl.[4] ..... B22D 27/02

[52] U.S. Cl. ..... 164/468; 164/504

[58] Field of Search ..... 164/468, 504, 502, 466, 164/147.1, 499

[56] References Cited

FOREIGN PATENT DOCUMENTS 3608711 10/1986 Fed. Rep. of Germany ..... 164/504

2485411 12/1981 France ..... 164/504

*Primary Examiner*—Kuang Y. Lin

[57] ABSTRACT

A casting mold in a continuous casting line has a counterflow electromagnetic stirring (CEMS) apparatus disposed about the mold. The CEMS apparatus includes electrically-conductive coils arranged in first and second groups of adjacent coils with the coils connected together in predetermined phase relationships for generating side-by-side magnetic fields in molten metal flowing through the casting mold. The first and second groups of adjacent coils are disposed respectively along respective halves of the casting mold with the coils in the first group generating one magnetic field and the coils in the second group generating the other magnetic field. The magnetic fields so generated in the molten metal move in counterrotating relation to one another about respective spaced axes extending generally parallel to one another and to the longitudinal axis of the casting mold. The counterrotating movement of the magnetic fields extends in transverse relation to the direction of molten metal flow through the casting mold and produces movement of molten metal in clockwise and counterclockwise stirring patterns in the casting mold in which the molten metal flowing in the respective patterns collide and intermix at the interface of the patterns.

6 Claims, 13 Drawing Sheets

COUNTERFLOW ELECTROMAGNETIC STIRRING METHOD AND APPARATUS FOR CONTINUOUS CASTING

This application is a continuation of application Ser. No. 07/107,436, filed Oct. 9, 1987, now abandoned.

CROSS REFERENCE TO RELATED APPLICATIONS

Reference is hereby made to the following copending applications dealing with related subject matter and assigned to the assignee of the present invention:

1. "Electromagnetic Apparatus For Restraining The Flow Of Molten Metal From A Vessel" by Christopher C. Alexion et al, assigned U.S. Ser. No. 698,485 and filed Feb. 5, 1985. (W.E. 51,881)

2. "Improved Discrete Excitation Coil Producing Seal At Continuous Casting Machine Pouring Tube Outlet Nozzle/Mold Inlet Interface" by Dennis Pavlik et al, assigned U.S. Ser. No. 050,272 and filed May 15, 1987. (W.E. 53,617)

3. "Liquid Metal Electromagnetic Flow Control Device Incorporating A Pumping Action" by Robert M. Del Vecchio et al, assigned U.S. Ser. No. 070,017 and filed July 6, 1987. (W.E. 53,973)

BACKGROUND OF THE INVENTION

1. Field of the Invention

The present invention relates generally to electromagnetic stirring of molten metal in continuous casting processes and, more particularly, is concerned with a counterflow electromagnetic stirring method and apparatus which generates counterflow stirring patterns that enhance mixing of the molten metal to produce an end product of improved quality.

2. Description of the Prior Art

Electromagnetic stirring (EMS) is utilized worldwide today as an aid in the production of continuous cast metals, such as steel and aluminum. The mission of EMS is quality improvement. The metallurgical benefits of EMS include: improved internal structure and cleanliness; and improved uniformity of composition and mechanical properties. EMS is applied at several locations in the continuous casting process: in the mold; below the mold; and in the final solidification zone. The stirring forces are caused by the interaction of applied magnetic fields and induced currents in a manner analogous to the operation of conventional induction motors. Depending on the type of strand being cast—billet, bloom or slab—the motor has a different physical configuration. The motions of the electromagnetic field produced by various EMS apparatuses heretofore have been rotary, linear or helical. In general, the EMS apparatuses are operated on AC either at line or at a reduced frequency, often below 10 Hz, although some DC apparatuses have been used.

For a description of the historical development of EMS, attention is directed to the following publications: "Design of Electromagnetic Stirrers For Continuous Casting" by Richard D. Nathenson et al, *Iron and Steel Engineer*, September 1986, p. 36; "Electromagnetic Stirring: Stepping Stone To Improved Continuously Cast Products" by H. S. Marr, *Iron And Steel International*, 1979, p. 29; and "EMS on Billet, Bloom And Slab Continuous Casters: State Of The Art in 1982" by J. P. Birat et al, 4th. International Congress of I.S.I., London, May 12, 1982. Representative of the prior patent art are the EMS apparatuses disclosed in U.S. Pat. Nos. to Dreyfus et al (2,573,319), Pestel et al (2,963,758), Taylor (3,235,243), Campbell (3,621,103), Von Starck (3,656,537), Hammarlund et al (3,709,476), Babel et al (3,804,147), Middleton et al (3,811,490), Ito et al (3,952,791 and 4,030,534), Sasaki et al (4,158,380), Birat et al (4,178,979), Zavaras et al (4,200,137), Delassus (4,321,958), Fujiwara et al (4,406,321), Winter et al (4,434,837 and 4,457,355) and Mulcahy (4,454,909), and in European Pat. Appln, No. 165,793 of Rostik et al.

Rotary electromagnetic stirring (REMS) apparatuses, along the lines of those disclosed in the abovecited Mulcahy patent and Rostik et al patent application, are widely used at the present time in the continuous casting industry. Such REMS apparatuses have been designed in various forms but all work on the same basic principles of electromagnetic induction. Basically, the apparatuses all contain a system of current-carrying conductor coils which produce a magnetic field moving in a direction transverse to the direction of molten metal travel through the continuous casting mold. This field penetrates the molten metal inducing electrical eddy currents which interact with the magnetic field to produce rotational stirring forces in the moving metal oriented transverse to its direction of flow. The metal attempts to follow the moving magnetic field and is thereby rotatably stirred.

More particularly, in the REMS apparatuses of the Mulcahy patent and Rostik application, a system of multi-phase excitation coils are typically wound about the mold and connected together in a manner very similar to the windings and connections of stators in conventional induction motors. Such coils form magnetic fields which move together to cause a continuous rotational motion of the molten metal in a common direction about the axis of the mold and transverse to the metal flow direction through the mold.

The continuous circular flow patterns induced by these REMS apparatuses cause the metal to circulate in a well ordered pattern, but do little to reduce the thermal gradients and material segregation that exist as the material cools from all outer surfaces inward toward the center of the mold. As a result, the rotary stirring of the metal produced by the Mulcahy-type REMS apparatuses is suboptimal in the sense that it fails to provide an end product having the high quality desired.

Consequently, a need still remains for a fresh approach to molten metal EMS in a continuous casting mold which will overcome the problems left unresolved by conventional REMS apparatuses such as disclosed in the Mulcahy paten and Rostik et al application.

SUMMARY OF THE INVENTION

The present invention provides a method and apparatus for producing unique counterflow stirring patterns designed to satisfy the aforementioned needs. The counterflow electromagnetic stirring (CEMS) apparatus of the present invention abandons the approach of the Mulcahy-type REMS apparatus which was to emulate operation of a conventional induction motor in causing rotational movement of the molten metal flow. In contrast thereto, the CEMS apparatus of the present invention adopts an approach which if applied to an induction motor would fail to produce any motion at all.

Whereas the prior art REMS apparatus generates a magnetic field moving in a rotational path, either clockwise or counterclockwise but not both at the same time, about the mold axis and across its cross-section, the CEMS apparatus of the present invention generates a pair of generally side-by-side magnetic fields which move in opposite directions across the mold cross-section, one clockwise and the other counterclockwise generally about respective axes offset laterally from opposite sides of the mold axis. The resultant effect is that two colliding magnetic fields are produced in the flowing metal across its transverse cross-section by the CEMS apparatus with two corresponding, distinct flow patterns introduced in the molten metal which resemble a "two-rotor egg-beater motion" with collision and recirculation present at the interface of the two fluid flow boundaries. Specifically, molten metal in one flow pattern is circulated around one half of the flow perimeter, drawn through the flow center at the interface of the two flow patterns where it intermixes with the molten metal in the other flow pattern, and then returned to the outer perimeter to repeat this cycle.

Unlike in the rotary stirring pattern generated by the prior art REMS apparatus wherein little or no mixing takes place between outer and inner regions of the metal flow, the counterflow stirring patterns generated by the CEMS apparatus of the present invention produce enhanced mixing of molten metal from the hot inner core into the cooler peripheral regions and thus generates a more homogeneous mixture of molten metal in the mold. Furthermore, heavier material impurities which tended to persist in the outer peripheral region of the metal flow due to centrifugal action created in the REMS apparatus are now recirculated by the counterflow stirring patterns of the CEMS apparatus of the present invention to the inner core region due to the constant exchange of material across the direction of metal flow between its hot inner core and outer cooler solidifying regions.

In a preferred embodiment of the CEMS apparatus of the present invention, the counterflow stirring patterns are produced by an arrangement of coils in first and second groups of adjacent coils disposed along respective halves of the casting mold (irrespective of the configuration of the mold). More specifically, the coils in the first group thereof are disposed adjacent to one another along adjacent mold sides defining one half of the mold, and, similarly, the coils in the second group thereof are disposed adjacent to one another along adjacent mold sides defining the other half of the mold. In contrast thereto, the paired coils in the prior art REMS apparatus which produce the rotary stirring pattern are disposed opposite to one another at respective opposite sides of the casting mold.

Accordingly, the present invention is directed to an apparatus for counterflow electromagnetic stirring (CEMS) of molten metal flowing in a predetermined direction which CEMS apparatus comprises: (a) a first arrangement of electrically-conductive coils being disposed adjacent to one another and connected together in predetermined phase relationships for generating a first magnetic field capable of electromagnetically inductively producing a first clockwise stirring pattern in the flowing molten metal in a transverse relation to the predetermined direction; and (b) a second arrangement of electrically-conductive coils disposed adjacent to one another and connected together in predetermined relationships for generating a second magnetic field capable of electromagnetically inductively producing a second counterclockwise stirring pattern in the flowing molten metal in a transverse relation to the predetermined direction and in colliding opposition to the first stirring pattern to produce intermixing together of molten metal flowing within the first and second stirring patterns. The first and second arrangements of coils are disposable respectively along respective halves of a casting mold such that the coils in the first arrangement generate the first magnetic field in generally one half of the mold and the coils in the second arrangement generate the second magnetic field in generally the other half of the mold.

More particularly, the CEMS apparatus comprises: (a) a first arrangement of electrically conductive coils having first longitudinal conductor segments extending generally parallel to one another and to the predetermined direction with the first conductor segments being disposed adjacent to one another and connected together in predetermined phase relationships for generating a first magnetic field capable of electromagnetically inductively producing a first clockwise stirring pattern in the flowing molten metal in a transverse relation to the predetermined direction; and (b) a second arrangement of electrically-conductive coils having second longitudinal conductor segments generally parallel to one another and to the predetermined direction with the second conductor segments being disposed adjacent to one another and connected together in predetermined phase relationships for generating a second magnetic field capable of electromagnetically inductively producing a second counterclockwise stirring pattern in the flowing molten metal in a transverse relation to the predetermined direction and in colliding opposition to the first stirring pattern to produce intermixing together of molten metal flowing within the first and second stirring patterns. The first and second longitudinal conductor segments of the first and second arrangements of coils are disposable respectively along respective halves of a casting mold such that the first longitudinal conductor segments in the first arrangement of coils generate the first magnetic field in generally one half of the mold and the second longitudinal conductor segments in the second arrangement of coils generate the second magnetic field in generally the other half of the mold.

Also, the present invention is directed to a method of continuous casting of metal which comprises the steps of: (a) providing a flow of molten metal in a predetermined direction through a casting mold; and (b) producing a counterflow electromagnetic stirring (CEMS) of the molten metal in the casting mold in transverse relation to the predetermined direction of molten metal flow through the casting mold to cause intermixing together of molten metal at outer, peripheral and inner, central regions of the casting mold. The CEMS of molten metal is produced in the casting mold in generally side-by-side clockwise and counterclockwise patterns of movement about respective spaced axes extending in directions generally parallel to the predetermined direction of molten metal flow.

More particularly, the producing step includes generating a pair of magnetic fields in the casting mold which move in transverse relation to the predetermined direction of molten metal flow and in colliding opposition to one another to produce the CEMS of the molten metal in the casting mold. Still further, the predetermined direction of molten metal flow through the casting mold is generally parallel to a longitudinal axis thereof. Also, the pair of magnetic fields are generated in the casting mold so as to move in counter-rotating relation to one another and in transverse relation to the predetermined direction of molten metal flow. The counterrotating relation of the magnetic fields produces a colliding counterflow stirring of the molten metal in the casting mold in generally clockwise and counterclockwise directions extending transversely to the predetermined direction of molten metal flow through the casting mold and about respective spaced axes extending generally parallel to and laterally offset from opposite sides of the longitudinal axis of the casting mold.

Further, the present invention is directed to an apparatus for continuous casting of metal which comprises, in combination: (a) a casting mold; (b) means for providing a flow of molten metal in a predetermined direction through the casting mold; and (c) means for producing a counterflow electromagnetic stirring (CEMS) of the molten metal in the casting mold in transverse relation to the predetermined direction of molten metal flow through the casting mold to cause intermixing together of molten metal at outer, peripheral and inner, central regions of the casting mold. The producing means produces the CEMS of molten metal in the casting mold in generally side-by-side clockwise and counterclockwise patterns of movement about respective spaced axes extending in directions generally parallel to the predetermined direction of molten metal flow.

More particularly, the producing means includes arrangements of electrically-conductive coils connected together in predetermined phase relationships for generating a pair of magnetic fields in the casting mold which move in transverse relation to the predetermined direction of molten metal flow and in colliding opposition to one another to produce the CEMS of the molten metal in the casting mold. Also, the arrangements of coils produce the CEMS of molten metal in generally side-by-side clockwise and counterclockwise patterns of movement about respective spaced axes extending in directions generally parallel to the predetermined direction of molten metal flow. The casting mold has a longitudinal axis and the predetermined direction of molten metal flow is generally parallel to the casting mold axis. The magnetic fields generated in the casting mold by the arrangements of coils move in counterrotating relation to one another and in transverse relation to the predetermined direction of molten metal flow. The counterrotating relation of the magnetic fields produces a colliding counterflow stirring of the molten metal in the casting mold in generally clockwise and counterclockwise directions extending transversely to the predetermined direction of molten metal flow through the casting mold and about respective axes extending generally parallel to and laterally offset from opposite sides of the longitudinal axis of the casting mold.

More specifically, the first and second arrangements of coils are disposable respectively along opposite halves of the casting mold. In such positions, the coils in the first arrangement generate one of the magnetic fields in the molten metal flowing generally in one half of the mold, whereas the coils in the second arrangement generate the other of the magnetic fields in the molten metal flowing generally in the opposite half of the mold.

Still further, the present invention is directed to a method of counterflow electromagnetic stirring (CEMS) of molten metal flowing in a predetermined direction. The CEMS method comprises the steps of: (a) electromagnetically inductively producing a first clockwise stirring pattern in the flowing molten metal in a transverse relation to the predetermined direction; and (b) electromagnetically inductively producing a second counterclockwise stirring pattern in the flowing molten metal in a transverse relation to the predetermined direction and in colliding opposition to the first stirring pattern to produce intermixing together of molten metal flowing within the first and second stirring patterns.

More particularly, the first clockwise stirring pattern is produced by generating a first magnetic field in the flowing molten metal moving in a clockwise direction generally about a first axis extending generally parallel to the predetermined direction. The second counterclockwise stirring pattern is produced by generating a second magnetic field in the flowing molten metal in generally side-by-side relation with the first magnetic field and moving in a counterclockwise direction about a second axis extending generally parallel to the first axis and the predetermined direction.

Yet further, the present invention is directed to an apparatus for counterflow electromagnetic stirring (CEMS) of molten metal flowing in a predetermined direction. The CEMS apparatus comprises: (a) first means for electromagnetically inductively producing a first clockwise stirring pattern in the flowing molten metal in a transverse relation to the predetermined direction; and (b) second means for electromagnetically inductively producing a second counterclockwise stirring pattern in the flowing molten metal in a transverse relation to the predetermined direction and in colliding opposition to the first stirring pattern to produce intermixing together of molten metal flowing within the first and second stirring patterns.

More particularly, the first means generates a first magnetic field in the flowing molten metal moving in a clockwise direction generally about a first axis extending generally parallel to the predetermined direction to produce the clockwise stirring pattern in the flowing molten metal. The second means generates a second magnetic field in the flowing molten metal in generally side-by-side relation with the first magnetic field and moving in a counterclockwise direction about a second axis extending generally parallel to the first axis and the predetermined direction to produce the counterclockwise stirring pattern in the flowing molten metal.

The first means includes a first arrangement of electrically-conductive coils connected together in predetermined phase relationships for generating the first magnetic field. The second means includes a second arrangement of electrically-conductive coils connected together in predetermined phase relationships for generating the second magnetic field.

Disconnectable and reconnectable connections are provided between the coils of the first arrangement and between the coils of the second arrangement allowing their interchangeability to establish the coils in a rotary electromagnetic stirring (REMS) mode to generate a single magnetic field moving in the conventional rotary stirring pattern or alternatively to establish the coils in the CEMS mode to generate the first and second magnetic fields moving in the counterflow, clockwise and counterclockwise stirring patterns.

Finally, the present invention is also directed to a method of converting an electromagnetic stirring (EMS) apparatus from a rotary electromagnetic stirring (REMS) mode to a counterflow electromagnetic stirring (CEMS) mode. The converting method comprises the steps of: (a) disconnecting a first arrangement of connections between a plurality of induction coils which establish the induction coils in a first predetermined phase relationship placing the apparatus in the REMS mode in which the coils generate a single rotating magnetic field capable of moving molten metal in a rotary stirring pattern; and (b) reconnecting the induction coils in a second arrangement of connections therebetween to establish the induction coils in a second predetermined phase relationship which places the apparatus in the CEMS mode in which the coils generate a pair of counterrotating and colliding magnetic fields capable of moving molten metal in counterflow stirring patterns.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
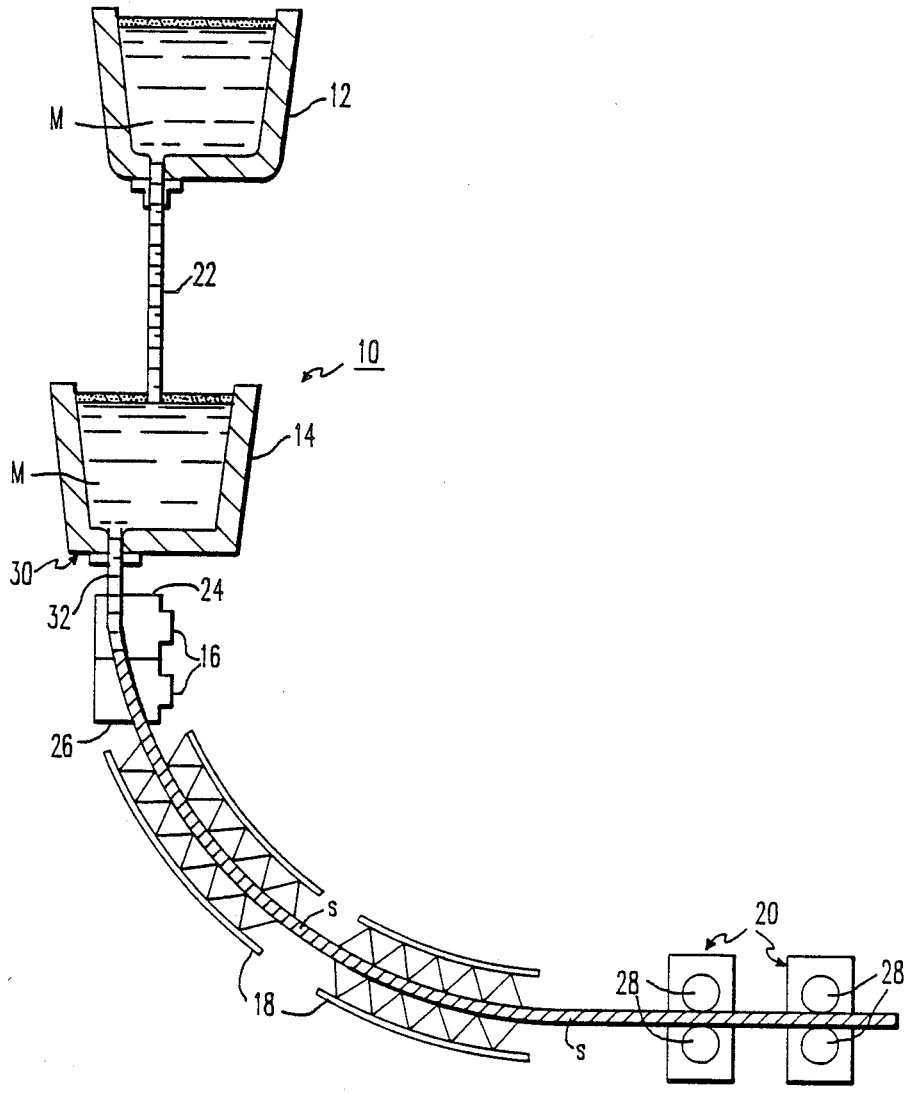
FIG. 1 (PRIOR ART)
FIG. 1 is a schematic representation of a prior art vertical continuous casting line.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

PRIOR ART CONTINUOUS CASTING LINE

Referring now to the drawings, and particularly to FIG. 1, there is shown a schematic representation of a continuous casting line, generally designated by the numeral 10, with which a CEMS apparatus constructed in accordance with the principles of the present invention which can be employed in the production of strands of continuous cast metals, such as steel and aluminum. Although the continuous casting line 10 is of the vertical type, the stirrer can be employed with other types, such as a horizontal line.

Typically, the continuous casting line 10 includes a ladle 12, a tundish 14, a casting mold 16, a spray zone 18 and a straightener 20 arranged in serial fashion. Hot molten metal M in a stream issues from the ladle 12 through a pouring tube 22 into the tundish 14. The tundish 14, in turn, infeeds the molten metal M contained therein in a free stream to an upper inlet end 24 of the casting mold 16. A continuous solid shell of metal S is formed around a liquid core in the casting mold 16 and withdrawn from a lower outlet end 26 thereof. The continuous shell or strand S is then fed through the spray zone 18 where it is progressively cooled to solidify the liquid core and thereafter the strand is fed between rolls 28 of the straightener 20.

PRIOR ART REMS APPARATUS

As described in the background section supra, various EMS apparatuses have been widely used during continuous casting for the purpose of improving the structural quality of the solidifying molten metal. The well-known explanation underlying REMS is that when the primary magnetic field produced by an arrangement of coils is moved, such as transversely, to the direction of flow of the conductive molten metal, electrical currents are induced in the metal which generates a secondary magnetic field of such polarity that the inducing and induced magnetic fields interact and produce a force which tends to move the conductive molten metal in the same transverse direction that the inducing magnetic field is moving. Thus, the molten metal will be caused to move in a stirring pattern around the rotational axis of the primary magnet field and in transverse relation to the direction of flow of the molten metal.

Figure 2:
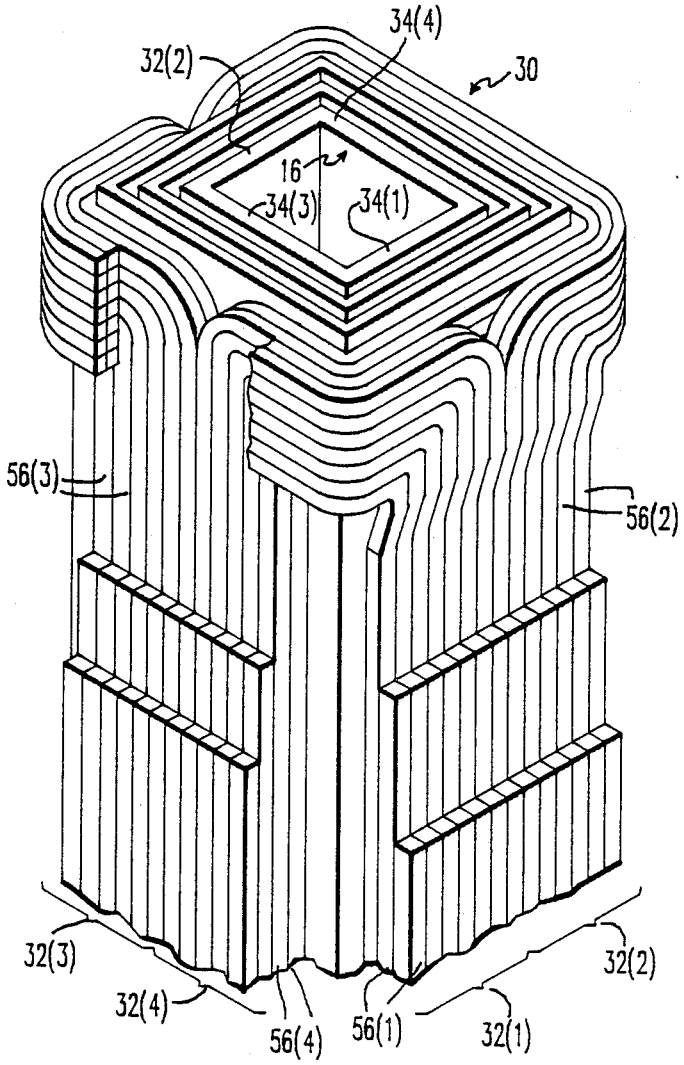
FIG. 2 (PRIOR ART)
FIG. 2 is a fragmentary perspective view of the coils of a first embodiment of a prior art REMS apparatus disposed along the sides of a rectangular-shaped casting mold.
Figure 3A:
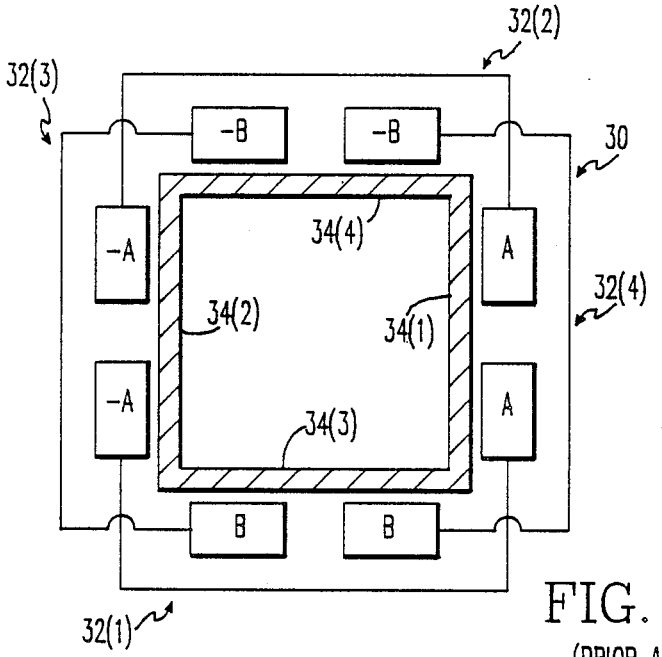
FIG. 3A (PRIOR ART)
FIG. 3A is a cross-sectional view of the apparatus coils and the mold of FIG. 2 providing a schematical representation of the respective phase relationships established between the coils of the prior art REMS apparatus and the respective positions of the coil along the sides of the mold for generating a rotary magnetic field.
Figure 3B:
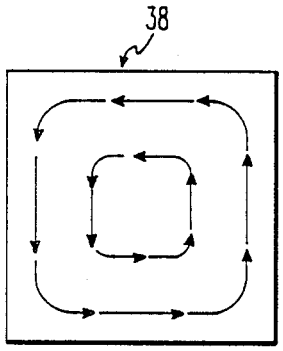
FIG. 3B (PRIOR ART)
FIG. 3B is a representation of a rotary stirring pattern induced transversely in the molten metal flow by the rotary magnetic field of the first embodiment of the prior art REMS apparatus of FIG. 2.
Figure 4:
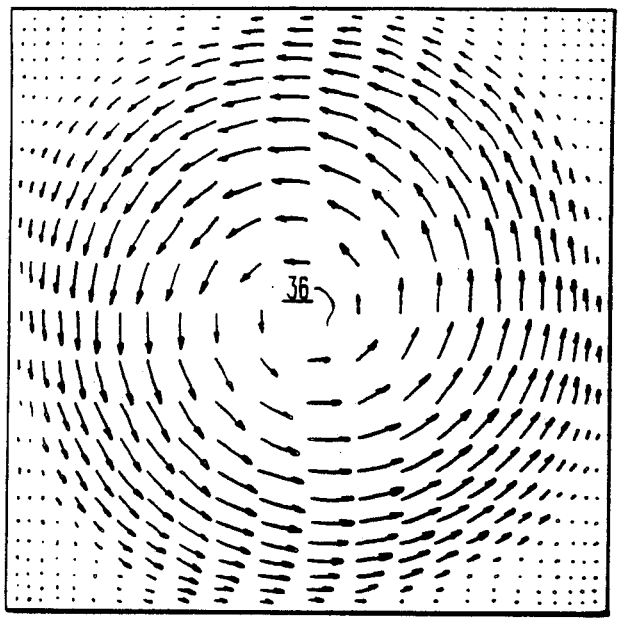
FIG. 4 (PRIOR ART)
FIG. 4 is a computer-generated plot simulating the relative fluid velocities in the rotary stirring pattern of the molten metal as produced by the rotary magnetic field of the first embodiment of the prior art REMS apparatus of FIG. 2.
Figure 8:
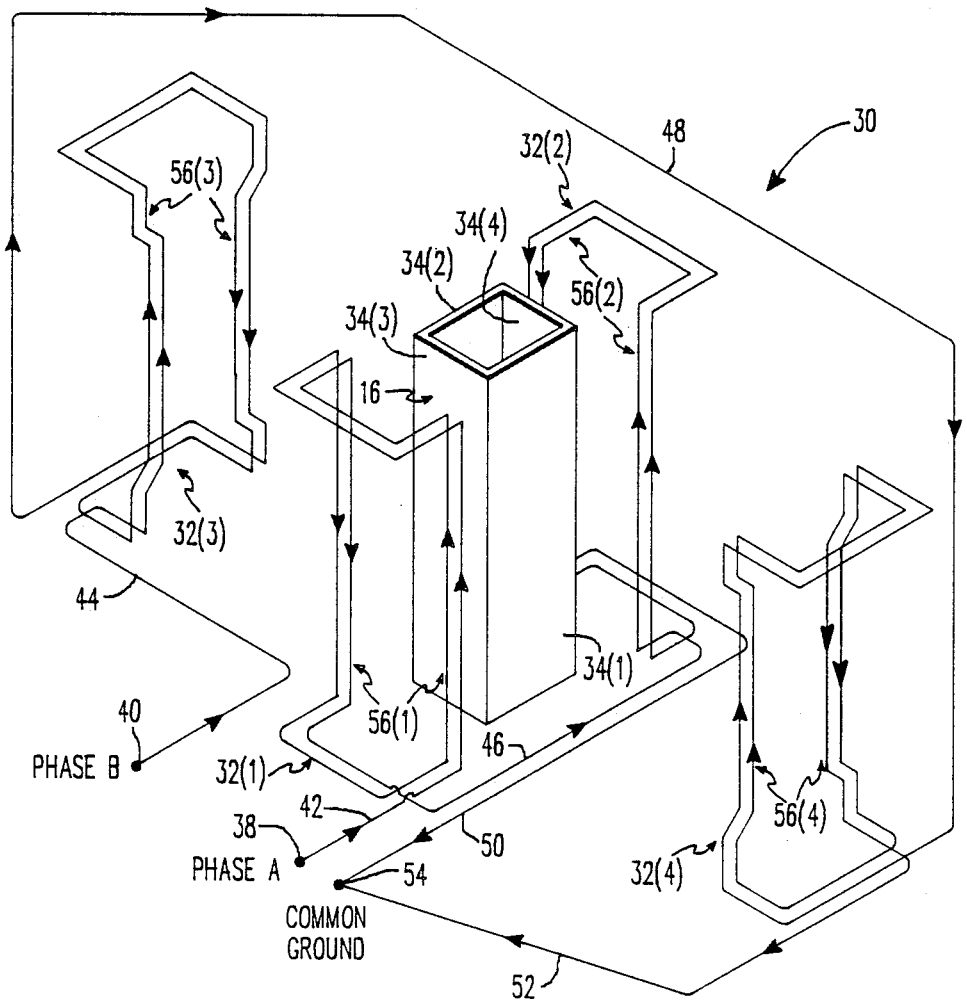
FIG. 8 (PRIOR ART)
FIG. 8 is a perspective view of the first embodiment of the prior art REMS apparatus of FIG. 2 and the casting mold associated therewith, the view providing a schematical representation of the coils and electrical connections therebetween and to the dual-phase AC power source and common ground in the prior art REMS apparatus with the positions of the coils shown relative to the respective sides of the mold.

In an REMS apparatus, such as disclosed in the above-cited Rostik et al patent application and as shown herein in FIGS. 2, 3A and 8 and generally designated by the numeral 30, it is conventional practice to arrange and connect together a plurality of coils 32(1)–32(4) (for instance of saddle-shaped configuration) along the interconnected longitudinal sides 34 of the casting mold 16 (the mold being rectangular-shaped in cross-section) to provide the phase relationships shown schematically in FIG. 3A. The two-phase relationships of the coils 32(1)–(4) will generate a single rotating magnetic field in the conductive molten metal. The magnetic field produces a rotary stirring pattern 36 in the metal, as represented by the arrows seen in FIG. 3B, moving in transverse relation to the direction of molten metal flow through the mold 16. The molten metal flow direction is perpendicular to the drawing sheet. FIG. 4 is a computer-generated plot simulating the relative fluid velocities of the molten metal in the rotary stirring pattern 36 of FIG. 3B as produced by the rotary magnetic field of the first embodiment 30 of the prior art REMS apparatus of FIG. 2.

Figure 9:
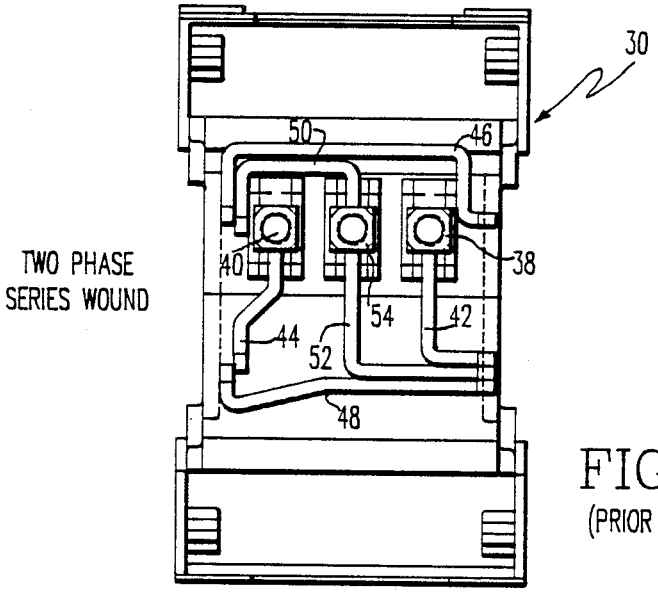
FIG. 9 (PRIOR ART)
FIG. 9 is a side elevational view of the prior art REMS apparatus of FIG. 2, showing the connections between the coils with the coils paired in series relationships.

More particularly, in the two-phase relationships, as represented by A and B in FIG. 3A, phases A and B are produced by sinusoidal AC currents 90 degrees out of phase with each other, with A and −A, and B and −B, being displaced from one another by 180 degrees. In phases A and B, current flows upwardly along the mold 16 (or out of the drawing sheet). In phases −A and −B the opposite is true, namely, current flows downwardly (or into the drawing sheet). The same convention for current flow is used later on in the illustrations of the CEMS apparatus of the present invention. Therefore, for example if A is at +270 degrees of the sinusoidal cycle, −A is at 90 degrees, B is at 180 degrees and −B is at 0 degrees. As shown in FIGS. 8 and 9, phase A and phase B currents are received from suitable sources (not shown) at inputs 38 and 40 and fed by leads 42 and 44 to coils 32(1) and 32(3) which, in turn, are respectively serially connected by leads 46 and 48 to coils 32(2) and 32(4). The coils 32(2) and 32(4) are connected by leads 50 and 52 to a common ground 54. It will be noticed that in the REMS apparatus 30, 180 degree-displaced current phases A and −A, and B and −B, of the respective connected coils 32(1)-(2), and 32(3)-(4), are disposed along respective pairs of opposite sides 34(1)-(2), and 34(3)-(4) of the casting mold 16 such that all current in vertical conductor segments 56(1)-(4) of the coils 32(1)-(4) flows vertically in the same direction along any given side 34(1)-(4) of the mold.

Figure 10:
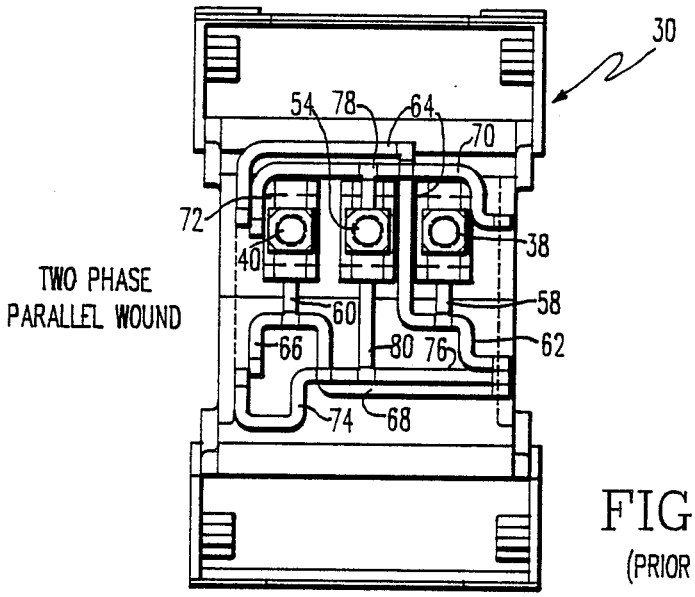
FIG. 10 (PRIOR ART)
FIG. 10 is a side elevational view of the prior art REMS apparatus of FIG. 2, showing the connections between the coils with the coils paired in parallel relationships.

Alternatively, the coils 32(1)-(2) and coils 32(3)-(4) of FIG. 8 can be connected in parallel. As illustrated in FIG. 10, phase A and phase B currents are received from suitable sources (not shown) at inputs 38 and 40 and fed by leads 58 and 60 respectively via parallel-connected leads 62 and 64 to coils 32(1)-(2) and via parallel-connected leads 66 and 68 to coils 32(3)-(4). The coils 32(1)-(2) and 32(3)-(4) are, in turn, respectively connected in parallel by leads 70 and 72 and leads 74 and 76 to the common ground 54 via leads 78 and 80.

FIGS. 5A-B, 6A-B and 7A-B merely illustrate examples of other embodiments of prior art REMS apparatuses 82, 84 and 86 and the coil arrangements and the respective phase relationships therebetween in conjunction with other rectangular and cylindrical casting molds for generating rotary magnetic fields and movement of the molten metal in transverse relation to its direction of flow in the rotary stirring patterns 88, 90 and 92. It is not believed necessary for a complete and thorough understanding of the CEMS apparatus of the present invention to described these other prior art embodiments in detail.

CEMS APPARATUS OF THE PRESENT INVENTION

Figure 11:
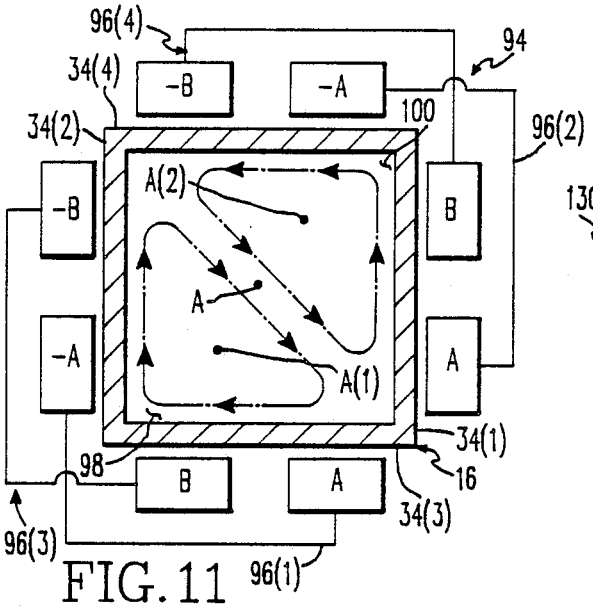
FIG. 11 is a cross-sectional view of a first embodiment of a CEMS apparatus of the present invention and a rectangular-shaped casting mold associated therewith, the view providing a schematical representation of the respective phase relationships established between groups of adjacent coils of the CEMS apparatus, of the respective positions of the groups of coils along the adjacent sides of the mold for generating a pair of colliding, counterrotating magnetic fields, and of clockwise and counterclockwise stirring patterns induced transversely in the molten metal flow by the counterrotating magnetic fields of the CEMS apparatus.
Figure 13:
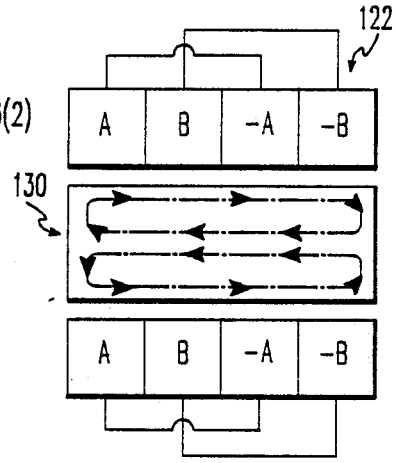
FIG. 13 is a cross-sectional view of a second embodiment of the CEMS apparatus of the present invention and a slab casting mold associated therewith, the view providing a schematical representation of the respective phase relationships established between coils of the CEMS apparatus, of the respective positions of the coils along the sides of the mold for generating a pair of colliding, counterrotating magnetic fields, and of clockwise and counterclockwise stirring patterns induced transversely in the molten metal flow by the counterrotating magnetic fields of the CEMS apparatus.
Figure 16B:
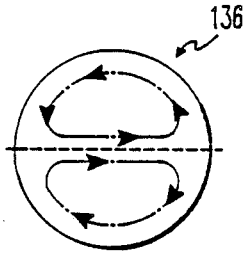
FIG. 16B is a representation of clockwise and counterclockwise stirring patterns induced in the molten metal flow by the counterrotating magnetic fields of the fifth embodiment of the CEMS apparatus of FIG. 16A.
Figure 15:
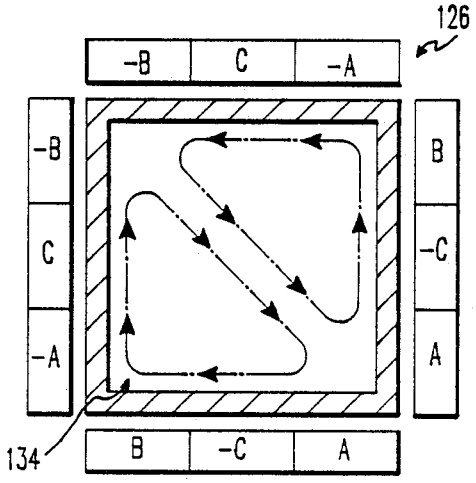
FIG. 15 is a cross-sectional view of a fourth embodiment of the CEMS apparatus of the present invention and the rectangular-shaped casting mold associated therewith, the view providing a schematical representation of the respective phase relationships established between coils of the CEMS apparatus, of the respective positions of the coils along the sides of the mold for generating a pair of colliding, counterrotating magnetic fields, and of clockwise and counterclockwise stirring patterns induced transversely in the molten metal flow by the counterrotating magnetic fields of the CEMS apparatus.
Figure 16A:
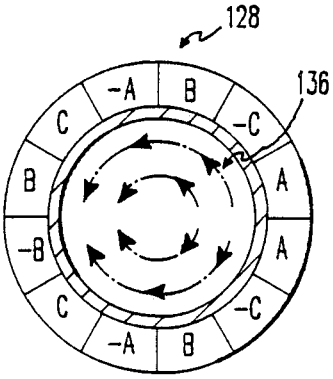
FIG. 16A is a cross-sectional view of a fifth embodiment of the CEMS apparatus of the present invention and a cylindrical casting mold associated therewith, the view providing a schematical representation of the respective phase relationships established between coils of the CEMS apparatus and the respective positions of the coils along the sides of the mold for generating a pair of colliding, counterrotating magnetic fields.
Figure 14:
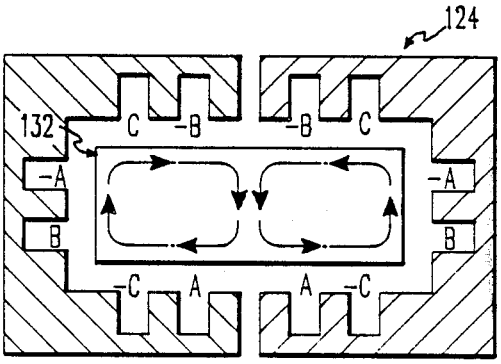
FIG. 14 is a cross-sectional view of a third embodiment of the CEMS apparatus of the present invention and a rectangular-shaped casting mold associated therewith, the view providing a schematical representation of the respective phase relationships established between coils of the CEMS apparatus, of the respective positions of the coils along the sides of the mold for generating a pair of colliding, counterrotating magnetic fields, and of clockwise and counterclockwise stirring patterns induced transversely in the molten metal flow by the counterrotating magnetic fields of the CEMS apparatus.
Figure 12:
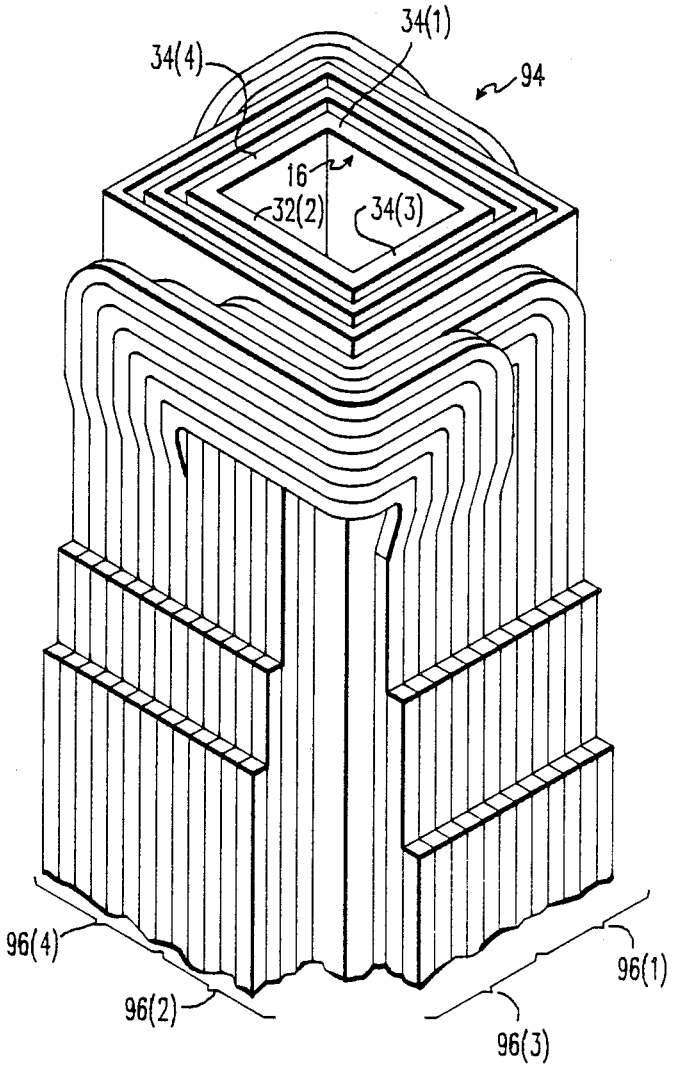
FIG. 12 is a fragmentary perspective view of the coils of the first embodiment of the CEMS apparatus schematically illustrated in FIG. 11.
Figure 18:
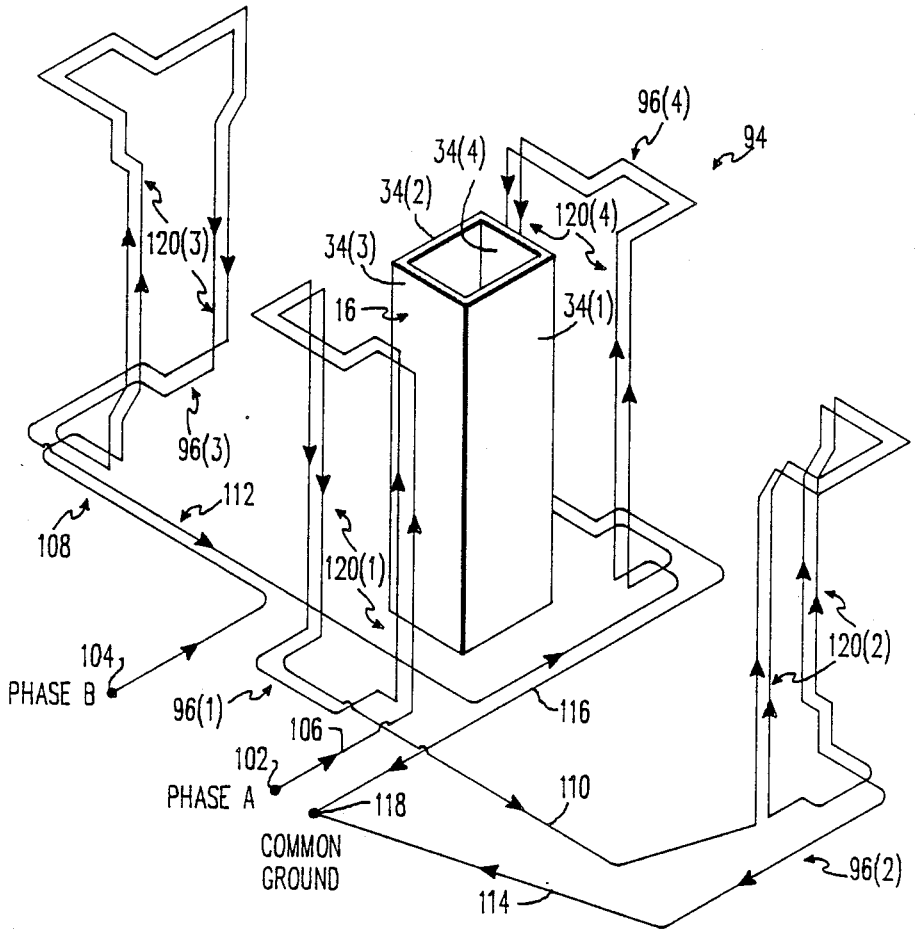
FIG. 18 is a perspective view of the first embodiment of the CEMS apparatus of FIG. 11 and the casting mold associated therewith, the view providing a schematical representation of the coils and electrical connections therebetween and to the dual-phase AC power source and common ground in the CEMS apparatus with the positions of the groups of coils shown relative to the respective adjacent sides of the mold.

Turning now to FIGS. 11, 12 and 18, there is illustrated a first embodiment of the CEMS apparatus of the present invention, being generally designated 94, which includes a plurality of coils 96(1)-96(4) arranged and connected together differently than the coils 32(1)-32(4) of the prior art REMS apparatus 30 as shown in FIGS. 3A and 8. The coils 96(1)-(4) are disposed along the interconnected longitudinal sides 34 of the casting mold 16, being rectangular-shaped in cross-section, to provide the phase relationships shown schematically in FIG. 11, which are different from the phase relationships of the prior art apparatus 30 shown in FIG. 3A. As will be explained below, the two-phase relationships and placements of the coils 96(1)-(4) will generate a pair of side-by-side magnetic fields in the casting mold 16 moving in counterrotating relation and colliding opposition to one another and in transverse relation to the direction of molten metal flow to produce a pair of colliding counterflow clockwise and counterclockwise stirring patterns 98 and 100, as depicted by the arrows in FIG. 11, in the molten metal in transverse relation to the direction of molten metal flow through the mold 16. The molten metal flow direction is perpendicular to the drawing sheet.

Figure 17:
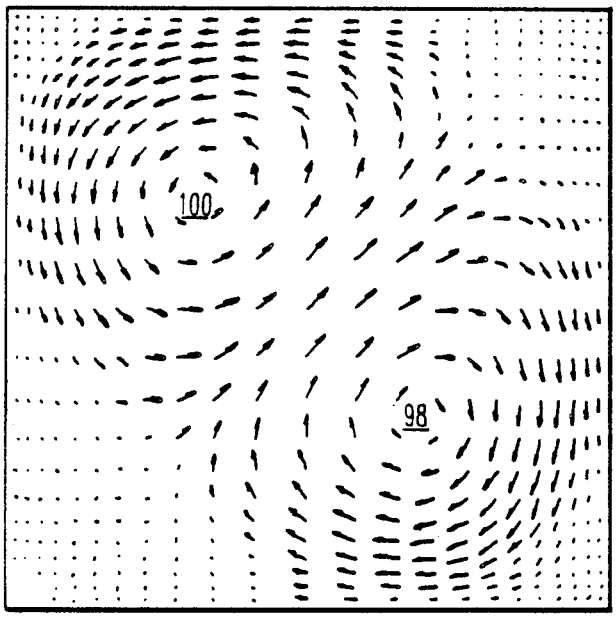
FIG. 17 is a computer-generated plot simulating the relative fluid velocities in clockwise and counterclockwise stirring patterns of the molten metal as produced by counterrotating magnetic fields of the first embodiment of the CEMS apparatus of the present invention illustrated schematically in FIG. 11.
Figure 5A:
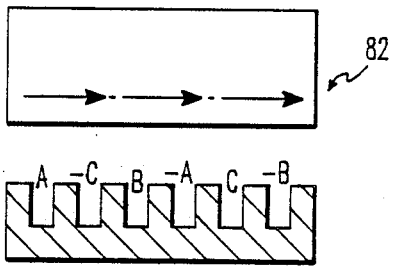
FIG. 5A (PRIOR ART)
FIG. 5A is a cross-sectional view of a second embodiment of a prior art REMS apparatus and a slab casting mold associated therewith, the view providing a schematical representation of the respective phase relationships established between the coils of the prior art REMS apparatus and the respective positions of the coils along the sides of the mold for generating a rotary magnetic field.
Figure 5B:
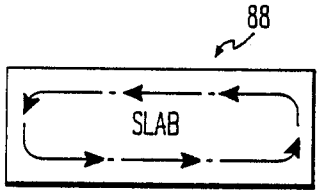
FIG. 5B (PRIOR ART)
FIG. 5B is a representation of a rotary stirring pattern induced in the molten metal flow by the rotary magnetic field of the second embodiment of the prior art REMS apparatus of FIG. 5A.
Figure 6A:
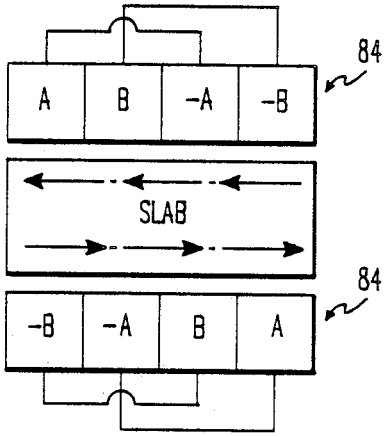
FIG. 6A (PRIOR ART)
FIG. 6A is a cross-sectional view of a third embodiment of a prior art REMS apparatus and another casting mold associated therewith, the view providing a schematical representation of the respective phase relationships established between the coils of the prior art REMS apparatus and the respective positions of the coils along the sides of the mold for generating a rotary magnetic field.
Figure 6B:
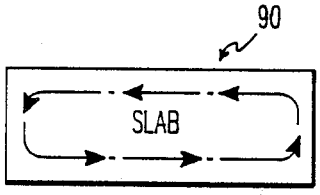
FIG. 6B (PRIOR ART)
FIG. 6B is a representation of a rotary stirring pattern induced in the molten metal flow by the rotary magnetic field of the third embodiment of the prior art REMS apparatus of FIG. 6A.
Figure 7A:
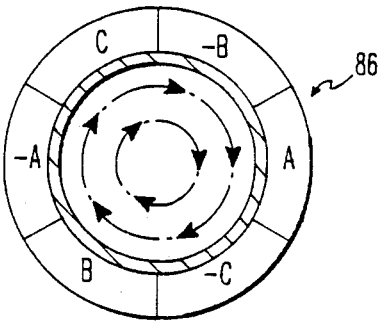
FIG. 7A (PRIOR ART)
FIG. 7A is a cross-sectional view of a fourth embodiment of a prior art REMS apparatus and a cylindrical casting mold associated therewith, the view providing a schematical representation of the respective phase relationships established between the coils of the prior art REMS apparatus and the respective positions of the coils along the sides of the mold for generating a rotary magnetic field.
Figure 7B:
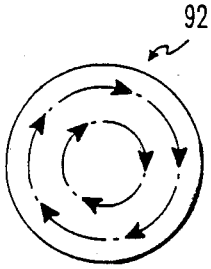
FIG. 7B (PRIOR ART)
FIG. 7B is a representation of a rotary stirring pattern induced in the molten metal flow by the rotary magnetic field of the fourth embodiment of the prior art REMS apparatus of FIG. 7A.

It can readily be appreciated that the colliding nature of the stirring patterns 98, 100 cause intermixing of molten metal at outer, peripheral and inner, central regions of the casting mold 16. The stirring patterns 98 and 100 counterrotate relative to one another about respective spaced axes A(1) and A(2) extending generally parallel to one another and to a longitudinal axis A of the casting mold 16. The three parallel axes A, A(1) and A(2) generally lie in a common plane, with the longitudinal axis A located between axes A(1) and A(2). FIG. 17 is a computer-generated plot simulating the relative fluid velocities of the molten metal in the counterflow stirring patterns 98, 100 of FIG. 11 as produced by the counterrotating magnetic fields of the first embodiment 94 of the CEMS apparatus of the present invention.

More particularly, in the two-phase relationships, as represented by A and B in FIG. 11, phases A and B are produced by sinusoidal AC currents 90 degrees out of phase with each other, with A and −A, and B and −B, being displaced from one another by 180 degrees. Therefore, for example if A is at +270 degrees of the sinusoidal cycle, −A is at 90 degrees, B is a 180 degrees and −B is at 0 degrees. As shown in FIG. 18, phase A and phase B currents are received from suitable sources (not shown) at inputs 102 and 104 and fed by leads 106 and 108 to coils 96(1) and 96(3) which, in turn, are respectively serially connected by leads 110 and 112 to coils 96(2) and 96(4). The coils 96(2) and 96(4) are connected by leads 114 and 116 to a common ground 118. It will be noticed that in the CEMS apparatus 94, 180 degree-displaced current phases A and −A, and B and −B, of the respective connected coils 96(1)-(2), and 96(3)-(4), are disposed along respective pairs of adjacent sides 34 (not opposite sides as in the case of the prior art REMS apparatus 30) of the casting mold 16 such that all current in vertical conductor segments 120(1)-(4) of the coils 96(1)-(4) flows vertically in the same direction along any given side 34 of the mold; but, unlike in the case of the prior art REMS apparatus 30, the current in one half of the conductor segments is not out of phase by 90 degrees with the current in the other half of the conductor segments along any given mold side.

In effect, in the CEMS apparatus 94, the coils 96(1)-(4) are provided in first and second groups thereof disposed respectively along respective halves of the casting mold 16. The coils 96(1) and 96(3) are in the first group provided along one half of the mold 16 defined by its adjacent ninety-degree displaced sides 34(3) and 34(2), and generate the one of the magnetic fields producing the clockwise stirring pattern 98. The coils 96(2) and 96(4) are in the second group provided along the other half of the mold 16 defined by its adjacent ninety-degree displaced sides 34(1) and 34(4), and generate the other of the magnetic fields producing the counterclockwise stirring pattern 100.

FIGS. 13–15 and 16A–B merely illustrate examples of other embodiments of CEMS apparatuses 122, 124, 126 and 128 and the coil arrangements and the respective phase relationships therebetween in conjunction with other rectangular and cylindrical casting molds for generating counterrotating and colliding magnetic fields and movement of the molten metal in transverse relation to its direction of flow in counterflow stirring patterns 130, 132, 134 and 136. It is not believed necessary for a complete and thorough understanding of the CEMS apparatus of the present invention to describe these other embodiments in detail. Suffice it to say, that the CEMS apparatuses 122 and 124 are configured for use with slab casting molds having generally rectangular-shapes and two relatively long sides and two relatively short sides interconnecting opposite ends of the long sides. The CEMS apparatus 122 is two-phase, whereas the CEMS apparatuses 124, 126 and 128 are three-phase. Th casting mold with which the CEMS apparatus 126 is used is generally square in shape, whereas the mold with which the CEMS apparatus 128 is used is cylindrical in shape having a continuous cylindrical side wall.

Figure 21:
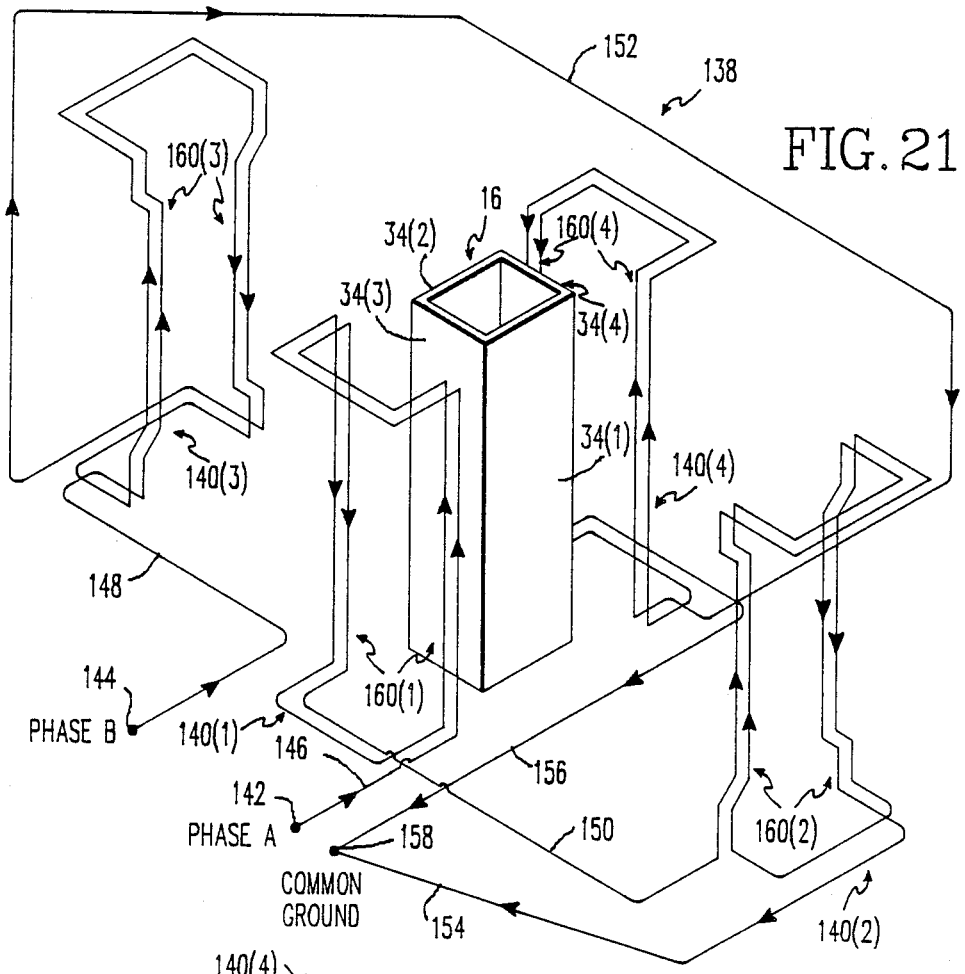
FIG. 21 is a perspective view of the alternative embodiment of the CEMS apparatus of FIG. 19 and the casting mold associated therewith, the view providing a schematical representation of the coils and electrical connections therebetween and to the dual-phase AC power source and common ground in the CEMS apparatus with the positions of the coils shown relative to the respective sides of the mold.
Figure 19:
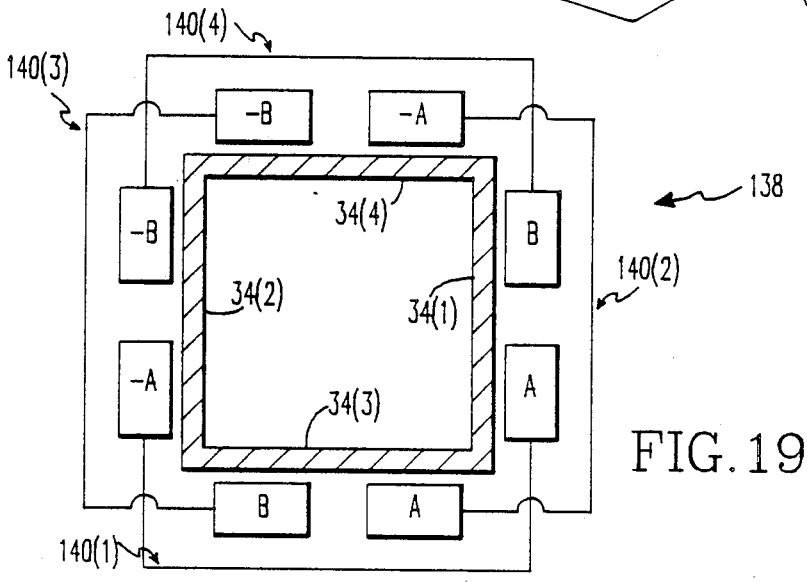
FIG. 19 is a cross-sectional view of an alternative embodiment of a CEMS apparatus of the present invention and a rectangular-shaped casting mold associated therewith, the view providing a schematical representation of the respective phase relationships established between coils in the alternative arrangement of the CEMS apparatus.
Figure 20:
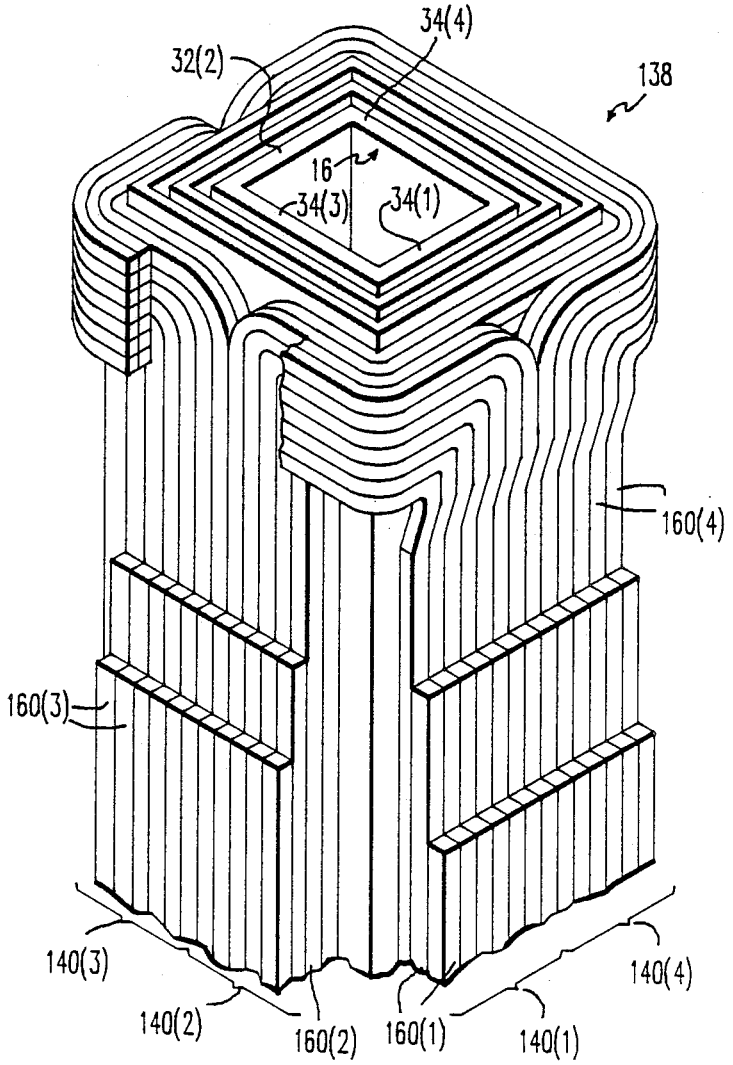
FIG. 20 is a fragmentary perspective view of the coils of the CEMS apparatus schematically illustrated in FIG. 19.

Turning now to FIGS. 19–21, there is illustrated another embodiment of the CEMS apparatus of the present invention, being generally designated 138, which includes a plurality of coils 140(1)–140(4) arranged (or wound) as in the case of the coils 32(1)–32(4) of the prior art REMS apparatus 30 of FIGS. 2 and 8, but connected together differently than the coils 32(1)–32(4) of the prior art REMS apparatus 30, and wound and connected together differently than the first embodiment 94 of the CEMS apparatus of the present invention. The coils 140(1)–(4) are disposed along the interconnected longitudinal sides 34 of the casting mold 16 (being rectangular-shaped in cross-section) to provide the phase relationships shown schematically in FIG. 19, which are identical to the phase relationships of the first embodiment 94 shown in FIG. 11 but different from those of the prior art apparatus 30 shown in FIG. 3A. As explained above with respect to the first embodiment 94 of the CEMS apparatus, like with the coils 96(1)–(4) the two-phase relationships and placements of the coils 140(1)–(4) will generate a pair of side-by-side magnetic fields in the casting mold 16 moving in counterrotating relation and colliding opposition to one another and in transverse relation to the direction of molten metal flow to produce the pair of colliding counterflow clockwise and counterclockwise stirring pattern 98 and 100, as depicted by the arrows in FIG. 11, in the molten metal in transverse relation to the direction of molten metal flow through the mold 16.

Figure 22:
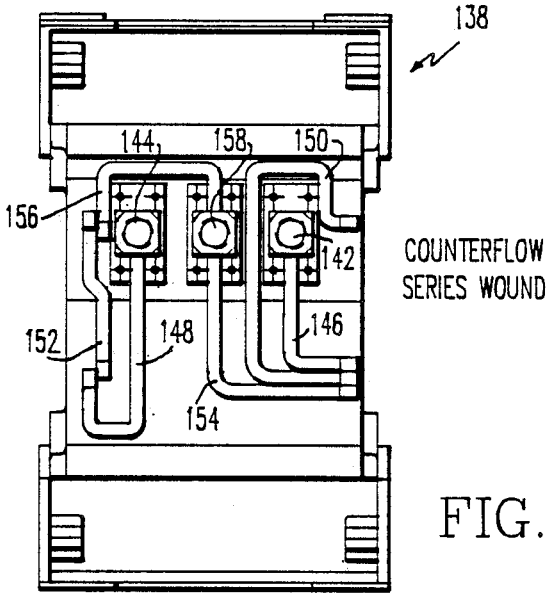
FIG. 22 is a side elevational view of the CEMS apparatus of FIG. 20, showing the connections between the coils with the coils paired in series relationships.

More particularly, as shown in FIGS. 21 and 22, phase A and phase B currents are received from suitable sources (not shown) at inputs 142 and 144 and fed by leads 146 and 148 to coils 140(1) and 140(3) which, in turn, are respectively serially connected by leads 150 and 152 to coils 140(2) and 140(4). The coils 140(2) and 140(4) are connected by leads 154 and 156 to a common ground 158. It will be noticed that in this embodiment 138 of the CEMS apparatus as in the first embodiment 94, 180 degree-displaced current phases A and −A, and B and −B, of the respective connected coils 140(1)–(2), and 140(3)–(4), are disposed along respective pairs of adjacent sides 34 (not opposite sides as in the case of the prior art REMS apparatus 30) of the casting mold 16 such that all current in vertical conductor segments 160(1)–(4) of the coils 140(1)–(4) flows vertically in the same direction along any given side 34 of the mold; but, unlike in the case of the prior art REMS apparatus 30, the current in one half of the conductor segments is now out of phase by 90 degrees with the current in the other half of the conductor segments along any given mold side.

In effect, in this embodiment 138 as in the first embodiment 94 of the CEMS apparatus, the coils 140(1)–(4) are provided in first and second groups thereof disposed respectively along respective halves of the casting mold 16. Certain ones of the vertical conductor segments 160 (1)–(4) of the coils 140 (1)–(4) are in the first group provided along one half of the mold 16 defined by its adjacent ninety-degree displaced sides 34(3) and 34(2), and generate the one of the magnetic fields producing the clockwise stirring pattern 98 (in FIG. 11). Certain ones of the vertical conductor segments 160 (1)–(4) of the coils 140 (1)–(4) are in the second group provided along the other half of the mold 16 defined by its adjacent ninety-degree displaced sides 34(1) and 34(4), and generate the other of the magnetic fields producing the counterclockwise stirring pattern 100 (in FIG. 11).

Figure 23:
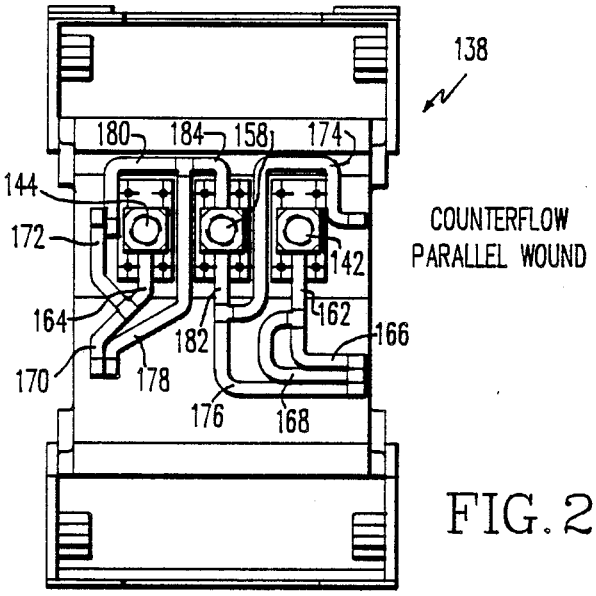
FIG. 23 is a side elevational view of the CEMS apparatus of FIG. 20, showing the connections between the coils with the coils paired in parallel relationships.

Alternatively, the coils 140(1)–(2) and coils 140(3)–(4) of FIG. 21 can be connected in parallel. As illustrated in FIG. 23, phase A and phase B currents are received from suitable sources (not shown) at inputs 142 and 144 and fed by leads 162 and 164 respectively via parallel-connected leads 166 and 168 to coils 140(1)–(2) and via parallel-connected leads 170 and 172 to coils 140(3)–(4). The coils 140(1)–(2) and 140(3)–(4) are, in turn, respectively connected in parallel by leads 174 and 176 and leads 178 and 180 to the common ground 158 via leads 182 and 184.

The choice of series versus parallel coil connections will be based on available power supply and cooling equipment. Cooling equipment for the coils have not been shown nor described since such does not form any part of the present invention.

Also, by comparing FIG. 9 with FIG. 22 and FIG. 10 with FIG. 23, it will be readily understood that the leads connecting the respective coils in the REMS apparatus 30 of FIGS. 2 and 8 can be interchanged with the leads connecting the respective coils in the REMS apparatus 138 of FIGS. 20 and 21. By doing so, the apparatus of FIG. 2 can be simply converted to establish the coils in a CEMS mode. Alternatively, by reversing the interchange of respective leads, the apparatus of FIG. 2 can be converted back to the REMS mode.

Thus, the counterflow stirring patterns can be implemented on existing REMS apparatus without the addition of any conductors. Instead, the paired relationships of the opposite-phase coils are electrically changed via appropriate modifications in their connections with one another to provide a different two-phase current distribution about the sides of the mold. The simplicity of these modifications and the ease with which they can be made means that currently installed prior art REMS apparatuses such as disclosed in the Mulcahy patent can be retrofitted to thereafter function to produce the counterflow stirring patterns. The necessity for substantial investments in new equipment to achieve CEMS is thereby avoided. Alternatively, connections can be added to such prior art REMS apparatuses for converting them from REMS to CEMS modes or vice versa in accordance with user's preferences.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. A method of converting an electromagnetic stirring (EMS) apparatus from a rotary electromagnetic stirring (REMS) mode to a counterflow electromagnetic stirring (CEMS) mode, said converting method comprising the steps of:

(a) disconnecting a first arrangement of connections between a plurality of induction coils which establish the induction coils in a first predetermined phase relationship placing the apparatus in the REMS mode in which the coils generate a single rotating magnetic field capable of moving molten metal in a rotary stirring pattern; and (b) reconnecting the induction coils in a second arrangement of connections therebetween to establish the induction coils in a second predetermined phase relationship which places the apparatus in the CEMS mode in which the coils generate a pair of counterrotating and colliding magnetic fields capable of moving molten metal in a pair of counterflow stirring patterns.

2. In a method of continuous casting of metal, the combination comprising the steps of:

(a) disconnecting a first arrangement of connections between a plurality of induction coils which establish the induction coils in a first predetermined phase relationship placing the apparatus in the REMS mode in which the coils generate a single rotating magnetic field capable of moving molten metal in a rotary stirring pattern; and (b) reconnecting the induction coils in a second arrangement of connections therebetween to establish the induction coils in a second predetermined phase relationship which places the apparatus in the CEMS mode in which the coils generate a pair of counterrotating and colliding magnetic fields capable of moving molten metal in a pair of counterflow stirring patterns;

(c) providing a flow of molten metal in a predetermined direction through a casting mold; and (d) producing counterflow electromagnetic stirring (CEMS) of the molten metal in the casting mold in transverse relation to said predetermined direction of molten metal flow through the casting mold so as to cause rotation in opposing clockwise and counterclockwise directions of side-by-side halves of the flow of the molten metal in adjacent halves of the casting mold and thereby intermixing together of the adjacent counterrotating molten metal halves at outer, peripheral and inner, central regions of the casting mold;

(e) said clockwise and counterclockwise stirring patterns of the side-by-side halves of the molten metal flow having outer portions located adjacent the respective halves of the casting mold and remote from one another which flow in the same direction along opposite portions of the mold halves;

(f) said clockwise and counterclockwise stirring patterns of the side-by-side halves of the molten metal flow having inner portions located adjacent to one another and remote from the respective halves of the casting mold which flow in the same direction next to one another.

3. The method as recited in claim 2, wherein said CEMS of molten metal is produced in the casting mold in the generally side-by-side clockwise and counterclockwise patterns of rotational movement about respective spaced axes extending in directions generally parallel to said predetermined direction of molten metal flow.

4. The method as recited in claim 2, wherein said producing step includes generating a pair of magnetic fields in the casting mold which move in transverse relation to said predetermined direction of molten metal flow and in colliding opposition to one another to produce said CEMS of the molten metal in the casting mold.

5. The method as recited in claim 4, wherein said CEMS of molten metal is produced in the casting mold in the generally side-by-side clockwise and counterclockwise patterns of rotational movement about respective spaced axes extending in directions generally parallel to said predetermined direction of molten metal flow.

6. In a method of continuous casting of metal, the combination comprising the steps of:

(a) disconnecting a first arrangement of connections between a plurality of induction coils which establish the induction coils in a first predetermined phase relationship placing the apparatus in the REMS mode in which the coils generate a single rotating magnetic field capable of moving molten metal in a rotary stirring pattern; and (b) reconnecting the induction coils in a second arrangement of connections therebetween to establish the induction coils in a second predetermined phase relationship which places the apparatus in the CEMS mode in which the coils generate a pair of counterroating and colliding magnetic fields capable of moving molten metal in a pair of counterflow stirring patterns:

(c) providing a flow of molten metal in a predetermined direction through a casting mold generally parallel to said longitudinal axis thereof; and (d) generating a pair of side-by-side magnetic fields in side-by-side halves of the casting mold moving in counterrotating relation to one another and in transverse relation to said predetermined direction of molten metal flow to produce colliding counterflow stirring rotations of side-by-side halves of the molten metal in the respective casting mold halves in generally clockwise and counterclockwise directions extending transversely to said predetermined direction of molten metal flow through the casting mold and about respective spaced axes extending generally parallel to and laterally offset from said longitudinal axis of said casting mold;

(e) said couterflow stirring rotations in generally clockwise and counterclockwise directions of the side-by-side halves of the molten metal flow having outer portions located adjacent the respective halves of the casting mold and remote from one another which flow in the same direction along opposite portions of the mold halves;

(f) said counterflow stirring rotations in generally clockwise and counterclockwise directions of the side-by-side halves of the molten metal flow having inner portions located adjacent to one another and remote from the respective halves of the casting mold which flow in the same direction next to one another.

* * * * *